US008183503B1

(12) United States Patent
Gupta

(10) Patent No.: US 8,183,503 B1
(45) Date of Patent: May 22, 2012

(54) ENCAPSULATED HEATING SYSTEM

(75) Inventor: Bosonto K. Gupta, Miami, FL (US)

(73) Assignee: Michael A. Valles, Lawrenceville, GA (US)

( * ) Notice: Subject to any disclaimer, the term of this patent is extended or adjusted under 35 U.S.C. 154(b) by 267 days.

(21) Appl. No.: 12/716,068

(22) Filed: Mar. 2, 2010

Related U.S. Application Data

(63) Continuation-in-part of application No. 12/422,954, filed on Apr. 13, 2009.

(51) Int. Cl.
*H05B 1/02* (2006.01)

(52) U.S. Cl. ..... 219/482; 219/505; 219/537; 219/541; 392/341; 392/441

(58) Field of Classification Search ..... 219/504, 219/505, 494, 537, 541, 539, 482; 392/441–464, 392/341
See application file for complete search history.

(56) References Cited

U.S. PATENT DOCUMENTS 3,497,677 A * 2/1970 Blain ..... 219/523
4,848,616 A * 7/1989 Nozaki ..... 204/196.11
4,972,067 A 11/1990 Lokar et al.
5,159,659 A * 10/1992 Cameron ..... 392/501
5,990,455 A * 11/1999 Scott et al. ..... 219/430
6,957,013 B2 * 10/2005 Zimmer ..... 392/397
2003/0021597 A1 * 1/2003 Chu ..... 392/486
2004/0131344 A1 * 7/2004 Zimmer ..... 392/397
2010/0116812 A1 * 5/2010 Watson et al. ..... 219/481

FOREIGN PATENT DOCUMENTS

WO WO9918756 4/1999

* cited by examiner

*Primary Examiner* — Mark Paschall
(74) *Attorney, Agent, or Firm* — George R. Reardon

(57) ABSTRACT

A reversible, submersible, encapsulated PTC heater is disclosed having: a disc-shaped sealable housing; a central disc comprised of a sheet mineral disposed within the sealable housing; cavities disposed within the central disc; PTC heating elements disposed within the cavities; an upper electrode disc disposed upon a top side of the central disc and PTC heater elements; a lower electrode disc disposed upon a bottom side of the central disc and PTC heater elements; an upper polyimide film disc disposed upon a top side of the upper electrode disc; and a lower polyimide film disc disposed upon a bottom side of the lower electrode disc. The electrode discs are configured to make an intimate contact with the PTC heating elements and for connectivity to an electrical power source. The PTC heater is configured to electrically heat a medium to a predetermined temperature and to maintain the temperature of the medium.

20 Claims, 5 Drawing Sheets

ENCAPSULATED HEATING SYSTEM

CROSS-REFERENCE TO RELATED APPLICATION(S)

This present non-provisional patent application is a continuation-in-part of copending U.S. patent application Ser. No. 12/422,954 filed on Apr. 13, 2009, and entitled "ENCAPSULATED HEATING SYSTEM," and of which the application cited above is incorporated in-full by reference herein.

FIELD OF THE INVENTION

The technology described herein relates generally to the fields of electrical heating systems, metal heaters, and thermistors with positive temperature coefficient (PTC) of resistance heating elements. More specifically, the technology relates to encapsulated heating systems with PTC heating elements.

BACKGROUND OF THE INVENTION

Positive temperature coefficient (PTC) of resistance heating elements are small ceramic stones with self-regulating temperature properties. Such heating elements can be utilized, for example, in heating systems. In a heating system, PTC thermistors can be placed between, and thermally coupled to, a pair of electrode plates in order to transfer heat.

Related patents known in the art include the following: U.S. Pat. No. 4,972,067, issued to Lokar et al. on Nov. 20, 1990, discloses a PTC heater assembly and a method of manufacturing the heater assembly. International Published Patent Application WO 99/18756, filed by Golan et al. on Oct. 1, 1998, discloses an immersible PTC heating device.

BRIEF SUMMARY OF THE INVENTION

In various exemplary embodiments, the technology described herein provides for encapsulated heaters. Each heater is reversible and submersible, configured for partial or complete immersion in the medium to be heated.

In one exemplary embodiment, the technology described herein provides a reversible, submersible, encapsulated PTC heater. The PTC heater includes: a disc-shaped sealable housing; a central disc comprised of a sheet mineral disposed within the sealable housing and having a central bore; a plurality of cavities disposed within the central disc; a plurality of positive temperature coefficient (PTC) of resistance heating elements disposed within the cavities within the central disc; an upper electrode disc disposed upon a top side of the central disc and plurality of PTC heater elements; and a lower electrode disc disposed upon a bottom side of the central disc and plurality of PTC heater elements; an upper polyimide film disc disposed upon a top side of the upper electrode disc; and a lower polyimide film disc disposed upon a bottom side of the lower electrode disc. In at least one embodiment, the housing is titanium. In at least one embodiment, the central disc is mica.

The upper electrode disc and the lower electrode disc each have a central bore and are configured for flexibility to make an intimate contact with a plurality of surface areas on the plurality of PTC heating elements, and configured for connectivity to an electrical power source.

The upper polyimide film disc and the lower polyimide film disc each have a central bore and each are configured to provide an electrical insulation.

The housing, the central disc, the plurality of PTC heating elements, the thin film electrode discs, and the polyimide film discs that form the PTC heater are adapted for encapsulation.

The PTC heater is configured to electrically heat a medium to a predetermined temperature and to maintain the temperature of the medium.

The housing of the PTC heater also can comprise an upper plate and a lower plate. The upper plate and the lower plate are configured to be sealably coupled.

The PTC heater can further include a retainer to secure, in order, the upper plate, upper polyimide film disc, upper electrode disc, the central disc, lower electrode disc, lower polyimide film disc, and the lower plate one to another in a stacked disc formation.

The PTC heater can further include a waterproof cable gland with which to sealably secure a plurality of cables to the lower electrode disc and the upper electrode disc within the housing of the PTC heater.

The PTC heater can further include a weight operatively disposed upon an underside of the PTC heater to adapt the reversible, submersible, encapsulated PTC heater for complete and sustained submersion.

The PTC heater can further include a float operatively disposed upon a topside of the PTC heater to adapt the reversible, submersible, encapsulated PTC heater for floatation.

The PTC heater can further include a float operatively disposed upon a topside of the PTC heater to adapt the reversible, submersible, encapsulated PTC heater as a deicer, to float upon a surface of a liquid.

The PTC heater can further include a plurality of gaskets with which to seal the housing.

In yet another exemplary embodiment, the technology described herein provides a PTC heater system. The PTC heater system includes: a disc-shaped sealable operatively floatable and submersible housing adapted for operative interchangeable floatation and submersion; a plurality of positive temperature coefficient (PTC) of resistance heating elements disposed within the housing; a pair of electrodes disposed upon opposing sides of the plurality of PTC heater elements and configured for connectivity to an electrical power source; a float; and a weight. The float and weight operatively are utilized to selectively float and submerse the PTC heater system. The PTC heater system is configured to electrically heat a medium to a predetermined temperature and to maintain the temperature of the medium. In at least one embodiment, the housing is titanium. In at least one embodiment, the central disc is mica.

The PTC heater system also can include a central disc comprised of a sheet mineral disposed within the sealable housing and a plurality of cavities disposed within the central disc. The plurality of PTC heater elements is disposed within the cavities.

The PTC heater system further can include an upper polyimide film disc disposed upon a top side of the upper electrode disc and a lower polyimide film disc disposed upon a bottom side of the lower electrode disc. The upper polyimide film disc and the lower polyimide film disc are configured to provide an electrical insulation.

The PTC heater system still further can include a waterproof cable gland with which to sealably secure a plurality of cables to the pair of electrodes within the housing of the PTC heater.

In yet another exemplary embodiment, the technology described herein provides a method for heating with a reversible, submersible, encapsulated metal PTC heater. The method includes: utilizing a plurality of positive temperature coefficient (PTC) of resistance heating elements disposed within a plurality of cavities disposed within a central disc comprised of a sheet mineral disposed within a disc-shaped sealable housing and having a central bore; layering an upper electrode disc upon a top side of the central disc and the plurality of PTC heater elements; and layering a lower electrode disc upon a bottom side of the central disc and the plurality of PTC heater elements; layering an upper polyimide film disc upon a top side of the upper electrode disc; and layering a lower polyimide film disc upon a bottom side of the lower electrode disc. The upper electrode disc and the lower electrode disc each have a central bore and are configured for flexibility to make an intimate contact with a plurality of surface areas on the plurality of PTC heating elements, and configured for connectivity to an electrical power source. The upper polyimide film disc and the lower polyimide film disc each have a central bore and each are configured to provide an electrical insulation. The housing, the central disc, the plurality of PTC heating elements, the thin film electrode discs, and the polyimide film discs that form the PTC heater are adapted for encapsulation. The PTC heater is configured to electrically heat a medium to a predetermined temperature and to maintain the temperature of the medium.

The method also can include utilizing a retainer and securing, in order, the upper plate, upper polyimide film disc, upper electrode disc, the central disc, lower electrode disc, lower polyimide film disc, and the lower plate one to another in a stacked disc formation.

The method further can include operatively attaching a weight to an underside of the PTC heater to adapt the reversible, submersible, encapsulated PTC heater for complete and sustained submersion.

The method still further can include operatively attaching a float to a topside of the PTC heater to adapt the reversible, submersible, encapsulated PTC heater for floatation.

Advantageously, the heaters and heater systems disclosed herein are energy efficient and typically consume approximately 75% less power than known heaters. Additionally, the heat output of the heaters and heater systems disclosed herein maintain the same heat output as that from coil heaters. Further advantageously, the heaters and heater systems disclosed herein provide for power shut off at approximately 363 degrees Fahrenheit, a temperature not hot enough to cause combustion. Still further advantageously, the heaters and heater systems disclosed herein do not require an over-temp protection fuse.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
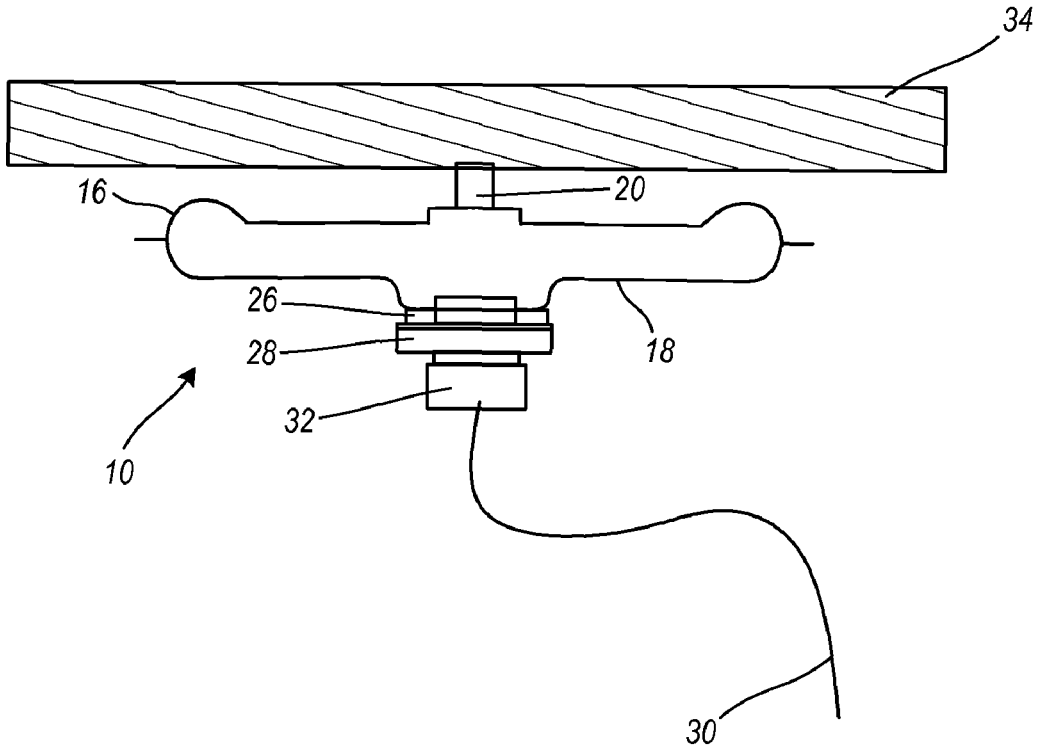
FIG. 1 is a side view of a reversible, submersible, encapsulated heater, illustrating, in particular, use as a floating heater suspended from a float, according to an embodiment of the technology described herein.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides for encapsulated heaters. Each heater is reversible and submersible, configured for partial or complete immersion in the medium to be heated.

Referring now to FIGS. 1 through 5, a submersible, encapsulated heater 10 is shown. The PTC heater 10 includes a disc-shaped sealable housing. In at least one embodiment, the housing comprises an upper plate 16 and a lower plate 18. The upper plate 16 and the lower plate 18 are configured to be sealable coupled. In at least one embodiment, the upper plate 16 and the lower plate 18 of the housing are titanium. However, in alternative embodiments, other durable metals can be utilized. By way of example, stainless steel is used in at least one embodiment. In at least one embodiment, upper plate 16 and the lower plate 18 can be integrally formed.

The PTC heater 10 includes a central disc 14. The central disc 14 is a sheet mineral disposed within the sealable housing and having a central bore. The central disc 14 includes a multiplicity of cavities. A multiplicity of positive temperature coefficient (PTC) of resistance heating elements 12 is disposed within the cavities within the central disc 14 (as depicted best in FIG. 3). In at least one embodiment, the central disc 14 of a sheet mineral is mica.

The PTC heater 10 includes an upper electrode disc 38 disposed upon a top side of the central disc 14 and multiplicity of PTC heater elements 12. The PTC heater 10 includes a lower electrode disc 38 disposed upon a bottom side of the central disc 14 and multiplicity of PTC heater elements 12.

The upper and lower electrode discs 38 each have a central bore. The upper and lower electrode discs 38 each are configured for flexibility to make an intimate contact with a multiplicity of surface areas on the multiplicity of PTC heating elements 12. The upper and lower electrode discs 38 each is configured for connectivity to an electrical power source such as, for example, power cable 30.

The PTC heater 10 includes an upper polyimide film disc 40 disposed upon a top side of the upper electrode disc 38. The PTC heater 10 includes a lower polyimide film disc 40 disposed upon a bottom side of the lower electrode disc 38. The upper and lower polyimide film discs 38 each have a central bore and each are configured to provide an electrical insulation. The polyimide film discs 40 aid in providing a temperature resistance of up to approximately 700 degrees Fahrenheit. The polyimide film discs 40 can be the Kapton® polyimide film manufactured by Du Pont®.

The housing 16, 18, the central disc 14, the multiplicity of PTC heating elements 12, the thin film electrode discs 38, and the polyimide film discs 40 that form the PTC heater 10 are adapted for encapsulation. The PTC heater 10 is configured to electrically heat a medium to a predetermined temperature and to maintain the temperature of the medium.

The PTC heater 10 includes a retainer 22 to secure, in order, the upper plate 16, upper polyimide film disc 40, upper electrode disc 38, the central disc 40, lower electrode disc 38, lower polyimide film disc 40, and the lower plate 18 one to another in a stacked disc formation. The retainer 22, in various embodiments, can be threaded, snapped, and force-fit configurations.

The PTC heater 10 includes a waterproof cable gland 32 with which to sealably secure a plurality of cables to the lower and upper electrode discs 38 within the housing of the PTC heater.

Figure 2:
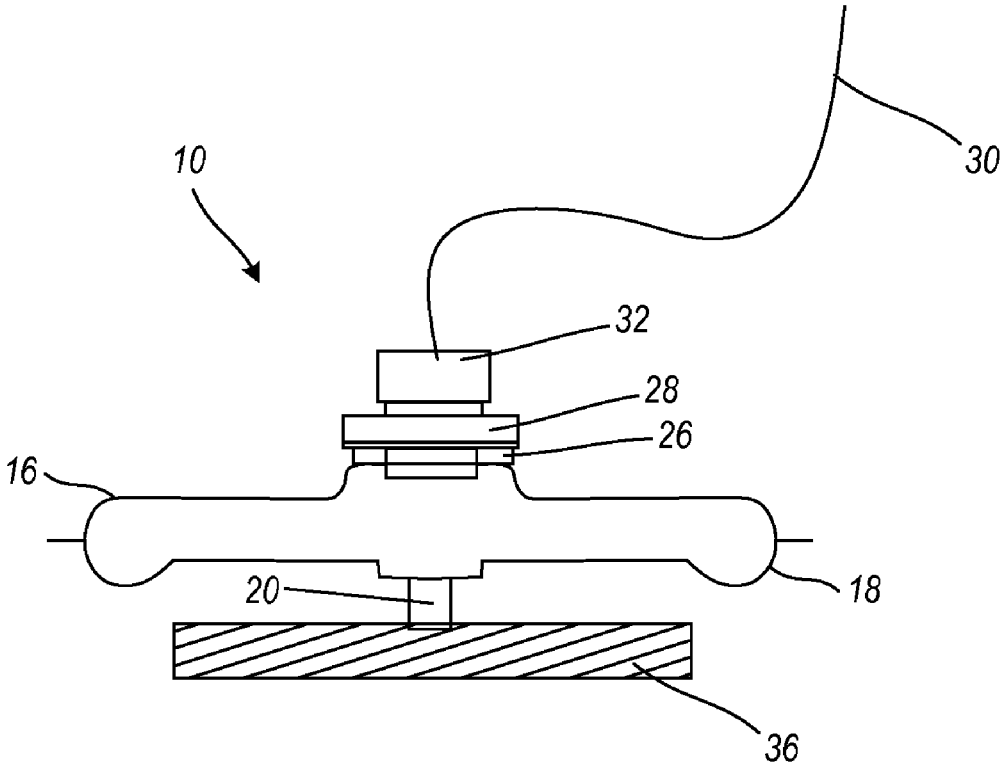
FIG. 2 is a side view of a reversible, submersible, encapsulated heater, illustrating, in particular, use as a submersible heater weighted downwardly by a suspended weight, according to an embodiment of the technology described herein.
Figure 3:
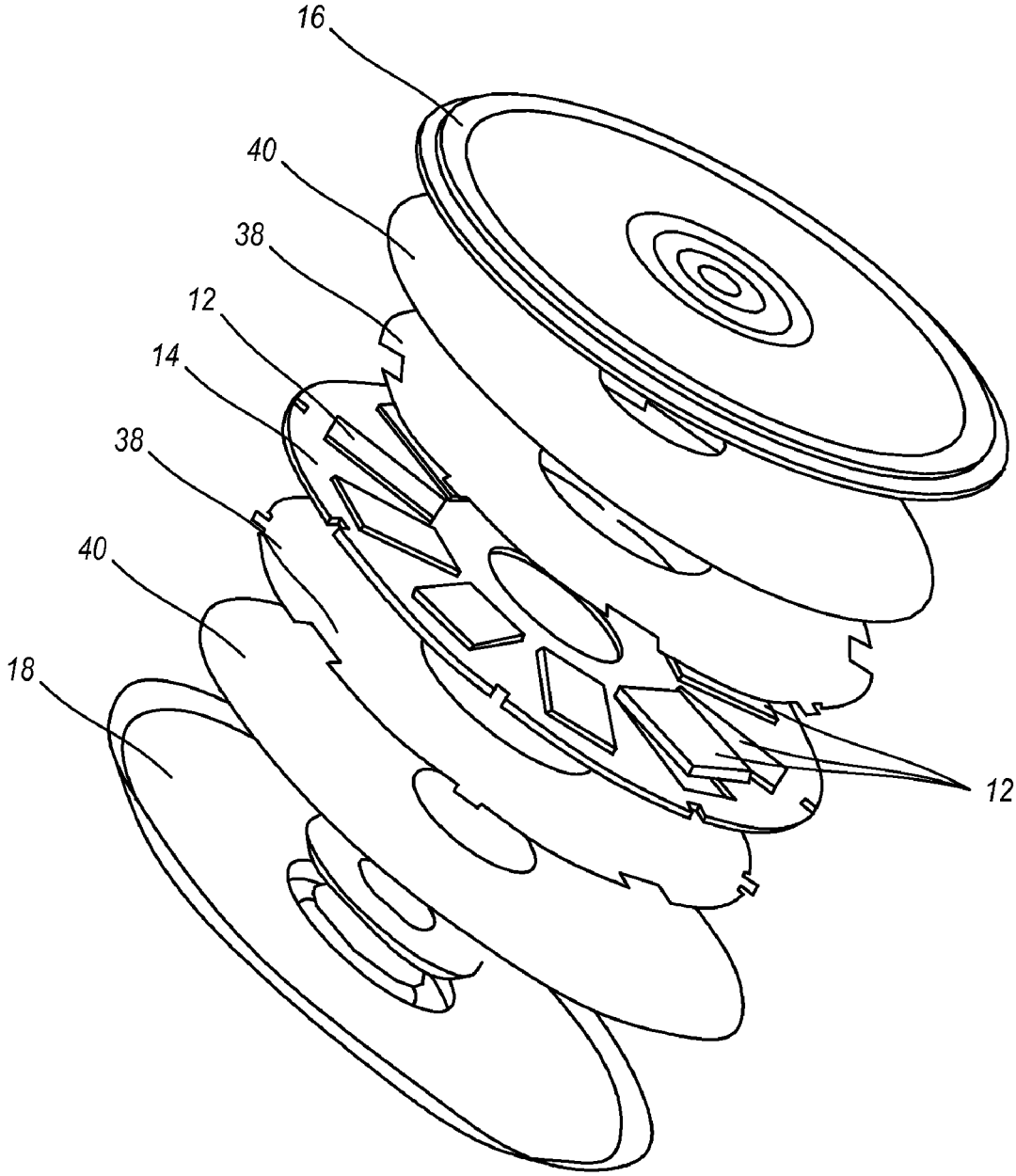
FIG. 3 is an expanded front perspective view of a reversible, submersible, encapsulated heater, illustrating, in particular, the various stacked layers of the heater, according to an embodiment of the technology described herein.
Figure 4:
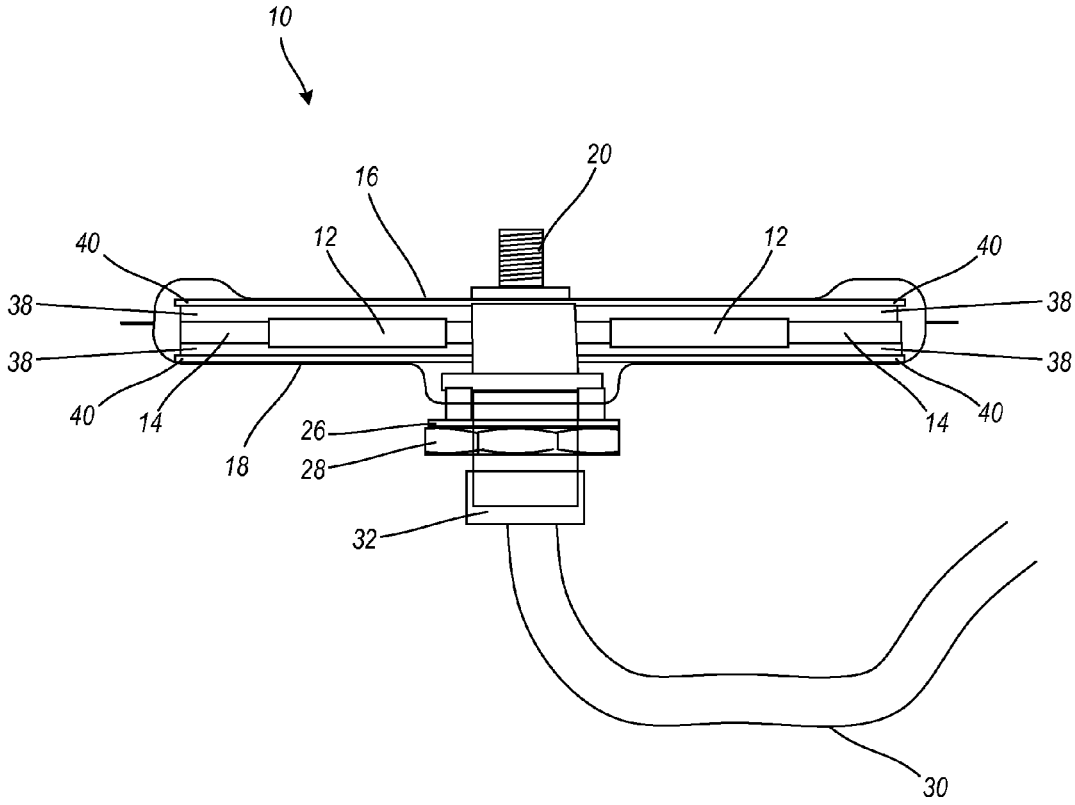
FIG. 4 a cross-sectional view of the reversible, submersible, encapsulated heater depicted in FIG. 1.
Figure 5:
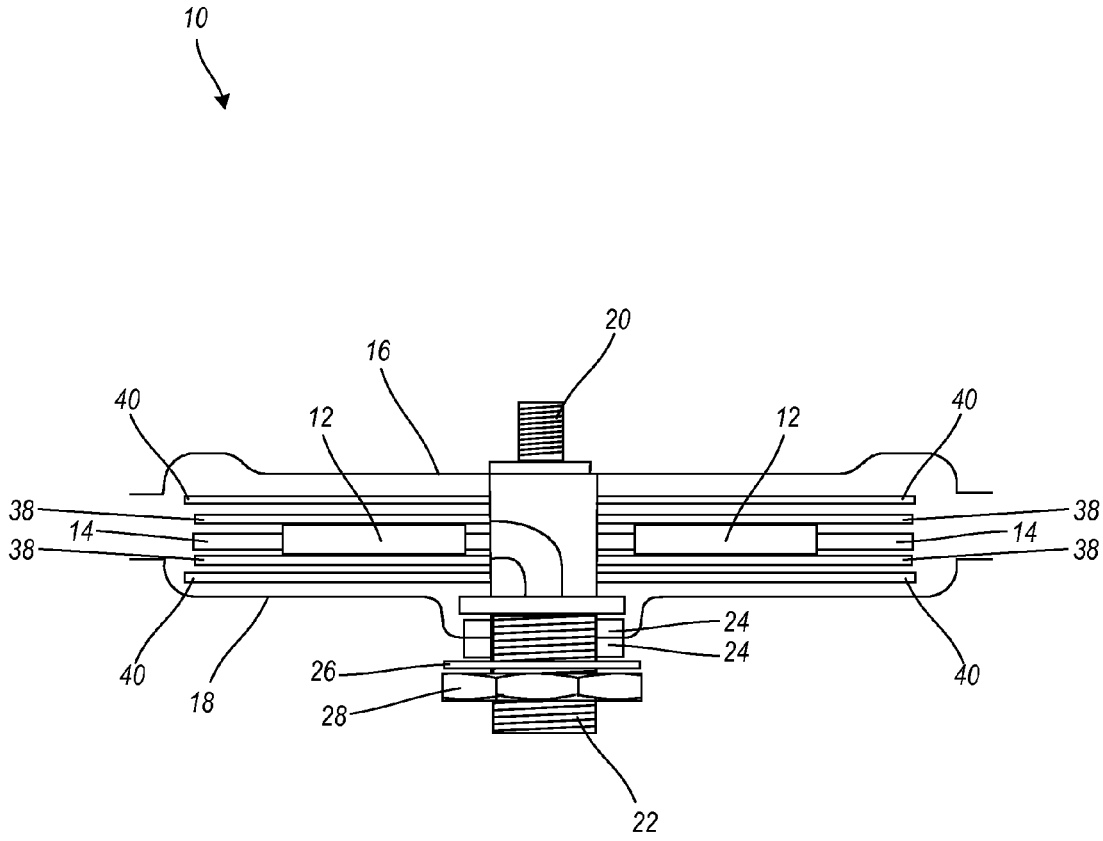
FIG. 5 is an expanded cross-sectional view of the reversible, submersible, encapsulated heater depicted in FIG. 1.

The PTC heater 10 can include a weight 36 operatively disposed upon an underside of the PTC heater 10 (as depicted in FIG. 2) at support 20 to adapt the reversible, submersible, encapsulated PTC heater for complete and sustained submersion.

The PTC heater 10 can include a float 34 operatively disposed upon a topside of the PTC heater at support 20 to adapt the reversible, submersible, encapsulated PTC heater for floatation.

The PTC heater 10 can include a float 34 disposed upon a topside of the PTC heater at support 20 to adapt the reversible, submersible, encapsulated PTC heater as a deicer, to float upon a surface of a liquid.

The PTC heater 10 can include gaskets 24 with which to seal the housing. The PTC heater 10 can include one or more washer 26 and one or more 28 to secure various discs and the upper plate 16 and lower plate 18 one to another to be sealably secured.

A method for heating with a reversible, submersible, encapsulated metal PTC heater 10 is disclosed herein. Method steps can include, in varying order, and with some steps omitted and others added as needed in a particular application: 1) utilizing a plurality of positive temperature coefficient (PTC) of resistance heating elements disposed within a plurality of cavities disposed within a central disc comprised of a sheet mineral disposed within a disc-shaped sealable housing and having a central bore; 2) layering an upper electrode disc upon a top side of the central disc and the plurality of PTC heater elements; 3) layering a lower electrode disc upon a bottom side of the central disc and the plurality of PTC heater elements; 4) layering an upper polyimide film disc upon a top side of the upper electrode disc; 5) layering a lower polyimide film disc upon a bottom side of the lower electrode disc; 6) utilizing a retainer; 7) securing, in order, the upper plate, upper polyimide film disc, upper electrode disc, the central disc, lower electrode disc, lower polyimide film disc, and the lower plate one to another in a stacked disc formation; 8) operatively attaching a weight to an underside of the PTC heater to adapt the reversible, submersible, encapsulated PTC heater for complete and sustained submersion; and 9) operatively attaching a float to a topside of the PTC heater to adapt the reversible, submersible, encapsulated PTC heater for floatation.

In use, the reversible, submersible, encapsulated metal PTC heater 10 is used with a float as a floating heater for liquid levels that fluctuate or as a deicer. The PTC heater 10 can be used with a weight, for example, to remain on the bottom of a tank as a submersible heater.

The reversible, submersible, encapsulated metal PTC heater 10 is adapted for use with 120 v and 240 v power sources. Additionally, a snap-in thermostat is included in at least one embodiment. Furthermore, an external digital thermostat control is included in at least one embodiment.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology and are intended to be covered by the following claims.

What is claimed is:

1. A reversible, submersible, encapsulated PTC heater comprising:

a disc-shaped sealable housing;

a central disc comprised of a sheet mineral disposed within the sealable housing and having a central bore;

a plurality of cavities disposed within the central disc;

a plurality of positive temperature coefficient (PTC) of resistance heating elements disposed within the cavities within the central disc;

an upper electrode disc disposed upon a top side of the central disc and plurality of PTC heater elements; and a lower electrode disc disposed upon a bottom side of the central disc and plurality of PTC heater elements;

wherein the upper electrode disc and the lower electrode disc each have a central bore and are configured for flexibility to make an intimate contact with a plurality of surface areas on the plurality of PTC heating elements, and configured for connectivity to an electrical power source;

an upper polyimide film disc disposed upon a top side of the upper electrode disc; and a lower polyimide film disc disposed upon a bottom side of the lower electrode disc;

wherein the upper polyimide film disc and the lower polyimide film disc each have a central bore and each are configured to provide an electrical insulation;

wherein, the housing, the central disc, the plurality of PTC heating elements, the thin film electrode discs, and the polyimide film discs that form the PTC heater are adapted for encapsulation; and wherein the PTC heater is configured to electrically heat a medium to a predetermined temperature and to maintain the temperature of the medium.

2. The reversible, submersible, encapsulated PTC heater of claim 1, wherein the housing comprises an upper plate and a lower plate, wherein the upper plate and the lower plate are sealably coupled.

3. The reversible, submersible, encapsulated PTC heater of claim 1, further comprising:

a retainer to secure, in order, the upper plate, upper polyimide film disc, upper electrode disc, the central disc, lower electrode disc, lower polyimide film disc, and the lower plate one to another in a stacked disc formation.

4. The reversible, submersible, encapsulated PTC heater of claim 1, wherein the housing comprises titanium.

5. The reversible, submersible, encapsulated PTC heater of claim 1, wherein the central disc comprised of a sheet mineral comprises mica.

6. The reversible, submersible, encapsulated PTC heater of claim 1, further comprising:

a waterproof cable gland with which to sealably secure a plurality of cables to the lower electrode disc and the upper electrode disc within the housing of the PTC heater.

7. The reversible, submersible, encapsulated PTC heater of claim 1, a weight operatively disposed upon an underside of the PTC heater to adapt the reversible, submersible, encapsulated PTC heater for complete and sustained submersion.

8. The reversible, submersible, encapsulated PTC heater of claim 1, a float operatively disposed upon a topside of the PTC heater to adapt the reversible, submersible, encapsulated PTC heater for floatation.

9. The reversible, submersible, encapsulated PTC heater of claim 1, further comprising:

a float operatively disposed upon a topside of the PTC heater to adapt the reversible, submersible, encapsulated PTC heater as a deicer, to float upon a surface of a liquid.

10. The reversible, submersible, encapsulated PTC heater of claim 1, further comprising:

a plurality of gaskets with which to seal the housing.

11. A PTC heater system comprising:

a disc-shaped sealable operatively floatable and submersible housing adapted for operative interchangeable floatation and submersion;

a plurality of positive temperature coefficient (PTC) of resistance heating elements disposed within the housing;

a pair of electrodes disposed upon opposing sides of the plurality of PTC heater elements and configured for connectivity to an electrical power source;

a float; and a weight;

wherein the float and weight operatively are utilized to selectively float and submerse the PTC heater system;

wherein the PTC heater system is configured to electrically heat a medium to a predetermined temperature and to maintain the temperature of the medium.

12. The PTC heater system of claim 11, further comprising:

a central disc comprised of a sheet mineral disposed within the sealable housing; and a plurality of cavities disposed within the central disc;

wherein the plurality of PTC heater elements are disposed within the cavities.

13. The PTC heater system of claim 11, further comprising:

an upper polyimide film disc disposed upon a top side of the upper electrode disc; and a lower polyimide film disc disposed upon a bottom side of the lower electrode disc;

wherein the upper polyimide film disc and the lower polyimide film disc are configured to provide an electrical insulation.

14. The PTC heater system of claim 11, wherein the housing comprises titanium.

15. The PTC heater system of claim 12, wherein the central disc comprised of a sheet mineral is mica.

16. The PTC heater system of claim 11, further comprising:

a waterproof cable gland with which to sealably secure a plurality of cables to the pair of electrodes within the housing of the PTC heater.

17. A method for heating with a reversible, submersible, encapsulated metal PTC heater, the method comprising:

utilizing a plurality of positive temperature coefficient (PTC) of resistance heating elements disposed within a plurality of cavities disposed within a central disc comprised of a sheet mineral disposed within a disc-shaped sealable housing and having a central bore;

layering an upper electrode disc upon a top side of the central disc and the plurality of PTC heater elements; and layering a lower electrode disc upon a bottom side of the central disc and the plurality of PTC heater elements;

wherein the upper electrode disc and the lower electrode disc each have a central bore and are configured for flexibility to make an intimate contact with a plurality of surface areas on the plurality of PTC heating elements, and configured for connectivity to an electrical power source;

layering an upper polyimide film disc upon a top side of the upper electrode disc; and layering a lower polyimide film disc upon a bottom side of the lower electrode disc;

wherein the upper polyimide film disc and the lower polyimide film disc each have a central bore and each are configured to provide an electrical insulation;

wherein, the housing, the central disc, the plurality of PTC heating elements, the thin film electrode discs, and the polyimide film discs that form the PTC heater are adapted for encapsulation; and wherein the PTC heater is configured to electrically heat a medium to a predetermined temperature and to maintain the temperature of the medium.

18. The method of claim 17, further comprising:

utilizing a retainer; and securing, in order, the upper plate, upper polyimide film disc, upper electrode disc, the central disc, lower electrode disc, lower polyimide film disc, and the lower plate one to another in a stacked disc formation.

19. The method of claim 17, further comprising:

operatively attaching a weight to an underside of the PTC heater to adapt the reversible, submersible, encapsulated PTC heater for complete and sustained submersion.

20. The method of claim 17, further comprising:

operatively attaching a float to a topside of the PTC heater to adapt the reversible, submersible, encapsulated PTC heater for floatation.

* * * * *